US006952839B2

(12) United States Patent
Long

(10) Patent No.: US 6,952,839 B2
(45) **Date of Patent: *Oct. 11, 2005**

(54) PADSET FOR PROTECTIVE HELMET

(75) Inventor: Richard J. Long, Lake Ariel, PA (US)

(73) Assignee: Gentex Corporation, Carbondale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/035,583

(22) Filed: Jan. 14, 2005

(65) Prior Publication Data

US 2005/0125882 A1 Jun. 16, 2005

Related U.S. Application Data

(63) Continuation of application No. 10/614,995, filed on Jul. 8, 2003, now Pat. No. 6,883,181.

(51) Int. Cl.[7] ..... A42B 3/00
(52) U.S. Cl. ..... 2/414; 2/417
(58) Field of Search ..... 2/414, 415, 417, 2/418, 419, 420, 411, 412, 909

(56) References Cited

U.S. PATENT DOCUMENTS 3,366,971 A * 2/1968 Scherz ..... 2/412
3,600,713 A * 8/1971 Holt ..... 2/83
3,673,609 A * 7/1972 De Simone ..... 2/414
3,713,640 A * 1/1973 Margan ..... 267/117
3,843,970 A * 10/1974 Marietta et al. ..... 2/415
4,534,068 A * 8/1985 Mitchell et al. ..... 2/414
5,035,009 A * 7/1991 Wingo et al. ..... 2/414
6,093,468 A * 7/2000 Toms et al. ..... 428/67
6,467,099 B2 * 10/2002 Dennis et al. ..... 2/455
6,493,881 B1 * 12/2002 Picotte ..... 2/413
6,499,147 B2 * 12/2002 Schiebl et al. ..... 2/425

* cited by examiner

*Primary Examiner*—Rodney M. Lindsey
(74) *Attorney, Agent, or Firm*—Keusey, Tutunjian & Bitetto, P.C.

(57) ABSTRACT

There is provided a pad set for a protective helmet. The pad set includes a plurality of internal pads of various thicknesses. A plurality of pad retaining/locating devices each have a pocket for receiving at least one of the plurality of internal pads so as to form an individual pad of the pad set. At least one fastener for each of the plurality of pad retaining/locating devices respectively secures each of the plurality of pad retaining/locating devices to a selected location within the protective helmet.

20 Claims, 4 Drawing Sheets

PADSET FOR PROTECTIVE HELMET

CROSS REFERENCE TO RELATED APPLICATIONS

This application is a Continuation of U.S. patent application Ser. No. 10/614,995 filed Jul. 8,2003, now U.S. Pat. No. 6,883,181 issued Apr. 26. 2005.

BACKGROUND OF THE INVENTION

1. Field of the Invention

This invention relates to adjustable pad sets for protective helmets and, more particularly, to audio headband accommodating pad sets.

2. Background of the Invention

Various forms of pad sets for protective helmets are known in the prior art. These pad sets are designed to provide comfort while maintaining helmet shell stability and adding supplemental impact protection at a given compression. In order to meet these various requirements, helmets may be "fitted" by selecting pads for a particular individual or size range. Thus, in the field, a wearer is relegated to a single issued pad set having limited flexibility in terms of alternate configurations, locations and thicknesses of the pads.

When using night vision goggles, it may be beneficial to shift the helmet aft. If shifting occurs without proper thickness adjustment or compression accommodation, stability may be jeopardized or hot spots may occur. Attempting to wear the helmet with an audio headband or other equipment may also result in hot spots. Ideally, the issued pad set would incorporate location adjustment with integral thickness matching to facilitate field-based re-configurations to maintain stability and compression without requiring outside tools, pads or other supplies.

Accordingly, it would be desirable and highly advantageous to have adjustable pad set for a protective helmet that overcomes the above-mentioned problems of the prior art.

SUMMARY OF THE INVENTION

The problems stated above, as well as other related problems of the prior art, are solved by the present invention, an adjustable pad set for a protective helmet.

According to an aspect of the present invention, there is provided an adjustable pad set for a protective helmet. The adjustable pad set includes a plurality of internal pads of various thicknesses. A plurality of pad retaining/locating devices each have a pocket for receiving at least one of the plurality of internal pads so as to form an individual pad of the adjustable pad set. At least one fastener for each of the plurality of pad retaining/locating devices respectively secures each of the plurality of pad retaining/locating devices to a selected location within the protective helmet.

According to another aspect of the present invention, there is provided a protective helmet capable of being worn with an audio headset having a headband. The protective helmet includes a padded shell having a re-locatable pad to provide a headband receiving zone. A fastener secures the re-locatable pad outside the headband receiving zone so that during headband use the re-locatable pad has an arcuate-shaped edge co-linear with a crown section of the headband and a spherical section extending away from the arcuate-shaped edge.

These and other aspects, features and advantages of the present invention will become apparent from the following detailed description of preferred embodiments, which is to be read in connection with the accompanying drawings.

DETAILED DESCRIPTION OF THE INVENTION

The present invention is directed to an adjustable pad set for a protective helmet. Each of the pads of the adjustable pad set is adjustable with respect to both location and thickness. By providing the capability to vary the location and thickness of each of the pads, numerous combinations for arranging the pads of the adjustable pad set are available to provide an optimized and individualized fit for a given user.

It is to be appreciated that the present invention advantageously provides an integral sizing system within the pads themselves. That is, adjustments to the overall thickness of a particular pad are made within the pad itself by removing or adding foam or other suitable material that make up the internal pads described below. In this way, a nominal compression of the foam (or other suitable material) can be obtained for maximum stability and comfort. In contrast, most prior art pad systems require users to add additional separate spacers or else remove a pad and replace that pad with one that is either thicker or thinner.

Each pad in an adjustable pad set according to the present invention includes one or more internal pads 110 of various thicknesses and a pad retaining/locating device 120 having a pocket 130 adapted to receive the one or more internal pads 110.

Figure 1C:
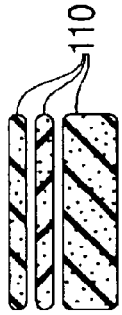
FIGS. 1A, 1B, and 1C are a series of diagrams illustrating an exemplary pad for an adjustable pad set for a protective helmet, according to an illustrative embodiment of the present invention.
Figure 2C:
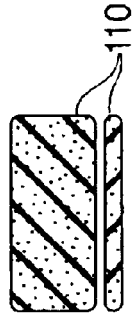
FIGS. 2A, 2B, and 2C are a series of diagrams illustrating another exemplary pad for another adjustable pad set for a protective helmet, according to another illustrative embodiment of the present invention.
Figure 1B:
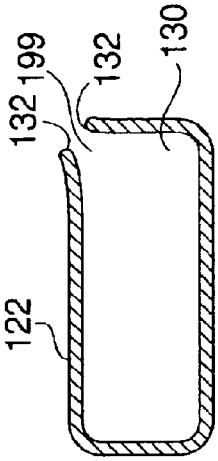
Figure 2B:
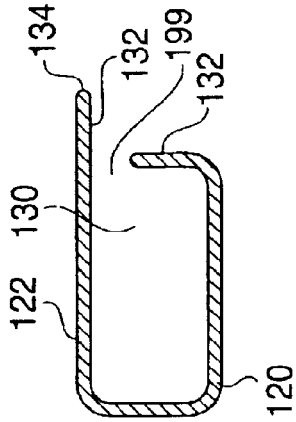
Figure 1A:
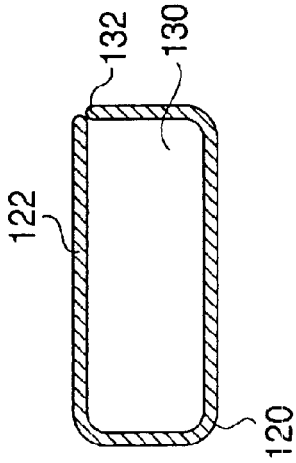
Figure 2A:
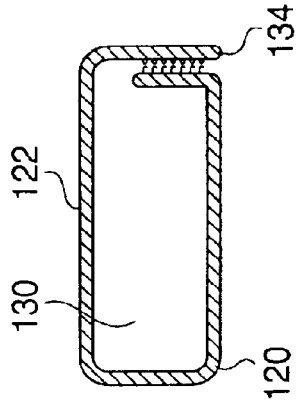

FIGS. 1A and 2A are diagrams illustrating various pad retaining/locating devices 120 in a closed position, and FIGS. 1B and 2B are diagrams illustrating the various pad/retaining locating devices 120 of FIGS. 1A and 1B, respectively, in an open position. FIGS. 1C and 2C are diagrams illustrating exemplary internal pads 100 that may be located within the pad retaining/locating devices 120.

The internal pads 110 may be formed from, but not limited to, the following materials: a viscoelastic foam (e.g., Confor®); polyurethane foam (e.g., per MIL-PFR-26514); and so forth. It is preferable that the material(s) that forms the internal pads 110 have at least one and preferably more than one of the following properties: waterproof or, at the least, water resistant; mildew and fungus resistant; durable; washable; and reversible.

The pad retaining/locating devices 120 may be formed from, but not limited to, the following fabrics and/or other materials: looped knit nylon. It is preferable that the material (s) that forms the pad retaining/locating devices 120 have at least one and preferably more than one of the following properties: waterproof or, at the least, water resistant; mildew and fungus resistant; durable; washable; and reversible.

The pad retaining/locating devices 120 may include one or more fasteners 122 (or portions thereof) for securing the pad retaining/locating devices 120 to a selected location within the protective helmet. The one or more fasteners 122 may be hook and pile fasteners and/or some other type of fastener(s).

The pad retaining/locating devices 120 may include one or more other fasteners 132 for keeping the pockets 130 closed to retain the one or more internal pads 110 within the pockets 130. The one or more other fasteners 132 may be disposed at an opening 199 of a pocket 130 for retaining the pocket 130 closed. The one or more other fasteners 132 may be hook and pile fasteners and/or some other type of fastener(s).

The opening 199 provided on each pocket 130 is used for adding the internal pads 110 to the pocket 130 and for removing internal pads 110 from the pocket 130. Preferably although not necessarily, the opening 199 is disposed on an edge of the pocket 130, as shown in FIGS. 1A–1B and 2A–2B. This prevents a buildup of material against a user's head. Further, by placing the opening 199 on an edge of the pocket 130, the pocket 130 (and hence the entire pad) can be turned over to contact the user on either side of the pad. This is an advantage for many reasons. For example, if one side of a pad becomes dirty or otherwise unsuitable/undesirable for being placed directly in contact with a user, then the pad can be flipped over and the other side of the pad can be placed in contact with the user without the user feeling any hot spots or other irregularities resulting from the opening. For example, placement of the opening on one of the two sides of the pad that can contact the user may result in the user undesirably feeling the opening or a hardware element associated with the opening such as re-enforcements (e.g., additional stitching), fasteners 132, and/or flaps 134. Moreover, the user may feel a perceptible difference in depth, if the opening is not fully closed such that a side of an internal pad closest to the user is slightly recessed in relation to the side of the pocket closest to the user. Of course, this perception is based in some part on the thickness of the pockets, since the greater the pocket wall the greater the disparity in depth that may be perceived by the user. Since laundering services may not readily be available to the user, this feature of the present invention extends the usefulness of the pads as well as their comfort. While some prior art pads may be reversible, they do not provide an integral sizing system within the pads themselves such that an opening is needed or even used and, therefore, do not have to consider the location of the opening with respect to any reason let alone user comfort. It is to be appreciated that the opening may be located along any portion of an edge of a pad including, for example, a top most or bottom most edge portion proximate to a side of the pad. That is, the opening need not be disposed centrally along an edge.

As in the embodiment of FIG. 2, the pad retaining/locating devices 120 may include one or more flaps 134 for covering the openings 199 of the pockets 130. Moreover, one or more of the other fasteners 132 may be disposed on the one or more flaps 134 in place of or in addition to any of the one or more other fasteners 132 disposed at the openings 199 for retaining the pockets 130 closed.

Figure 3:
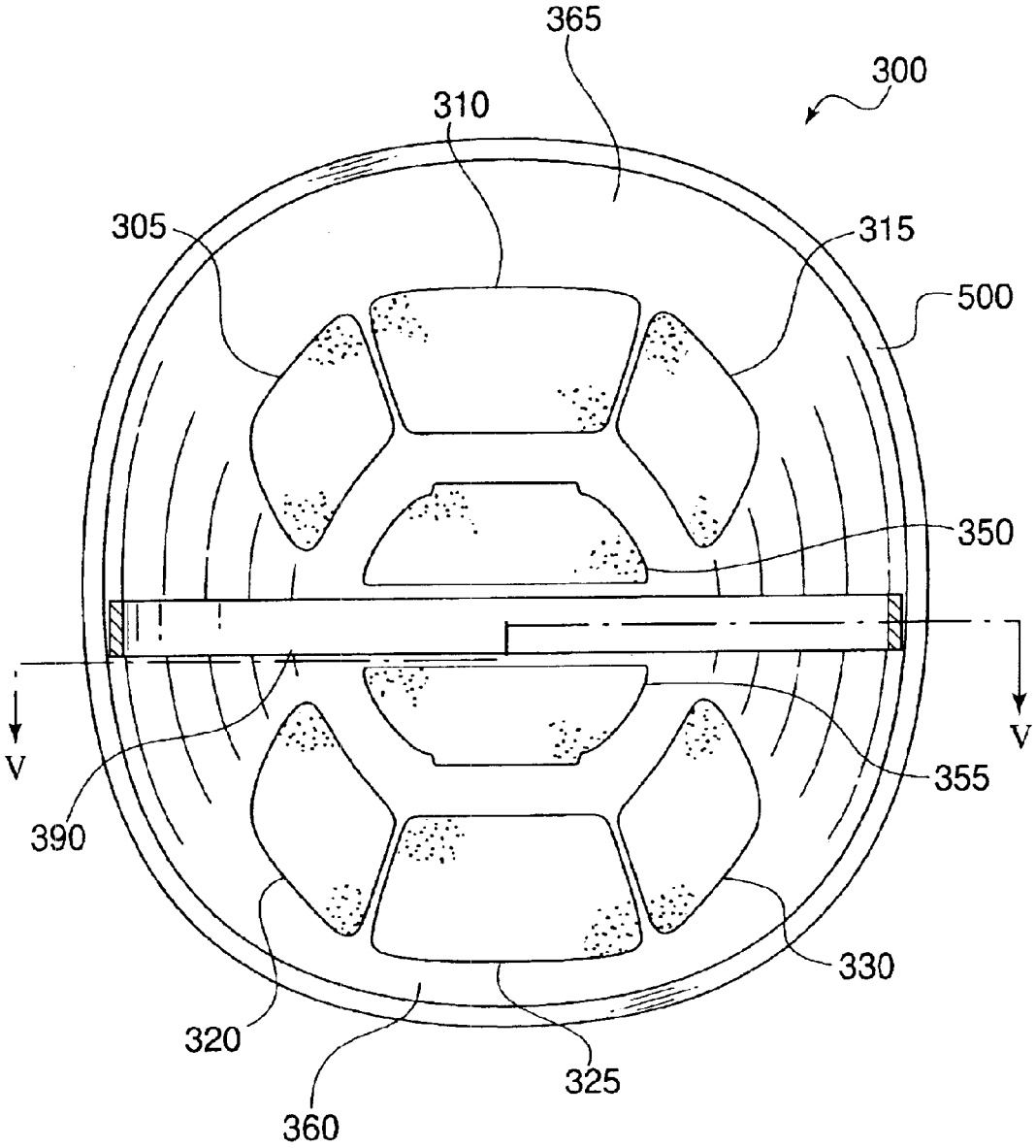
FIG. 3 is diagram illustrating an exemplary adjustable pad set 300 for a protective helmet, according to an illustrative embodiment of the present invention.

FIG. 3 is diagram illustrating an exemplary adjustable pad set 300 for a protective helmet, according to an illustrative embodiment of the present invention. The adjustable pad set 300 includes a plurality of individual pads 305, 310, 315, 320, 325, 330, 350, and 355. In the illustrative embodiment of FIG. 3, the adjustable pad set 300 is intended for use along with an audio headset having a headband 390 as a part thereof. The other elements of the audio headset are not shown in FIG. 3 (or FIG. 4 below). Each of the individual pads 305, 310, 315, 320, 325, 330, 350, and 355 may be formed from one or more internal pads 110 and a pad retaining/locating device 120.

Thus, the pads of the adjustable pad set 300 are arranged in a pattern so that at least two pads 350, 355 are disposed to allow the headband 390 of the audio headset to pass there between. The location of the at least two pads 350, 355 correspond to the crown portion of a wearer's head. By separating the at least two pads 350, 355 to allow the headband 390 to pass there between, the present invention advantageously maintains a consistent offset between the helmet shell and the user's head, with or without the headband 390 in place. Without this feature, the use of a headband such as headband 390 would cause the helmet to sit higher on the user's head when the headband 390 is in place and would cause the helmet to sit lower on the user's head when the headband is not being used. Thus, without the feature (i.e., as in the prior art), an inconsistent offset of the helmet results when a user switches from using a headband to not using a headband. Moreover, in the former case, a pressure point may be felt on the user's head when the headband is used with prior art pad sets, a problem obviated by the pad set of the present invention shown and described with respect to FIG. 3. Further, while a special crown pad could be employed in the prior art to possibly overcome some of the above-described problems when using a headband 390 of an audio headset, the pad set of FIG. 3 does not require the addition or removal of any special pads.

The pads are preferably, but not necessarily, of different shapes and sizes corresponding to different areas of a wearer's head. Such areas include, but are not limited to, a crown area, a brow area, a dome area, side areas, and so forth. The use of different shapes and sizes further adds to the optimized and individualized fit of the pad set for a given wearer, along with the capability of varying the location and thickness of each of the pads. This allows a wearer to employ a thicker and/or wider pad at the forehead area, if needed, to compensate for additional weight imparted on the front of the helmet due to the coupling of a Night Vision Device (NVD) thereto. However, the pads may be of the same size and overall shape to facilitate interchangeability of the pads with respect to different locations within the helmet. Preferably, pads 310 and 325 are of the same size and pads 305, 315, 320, and 330 are of the same size.

Figure 4:
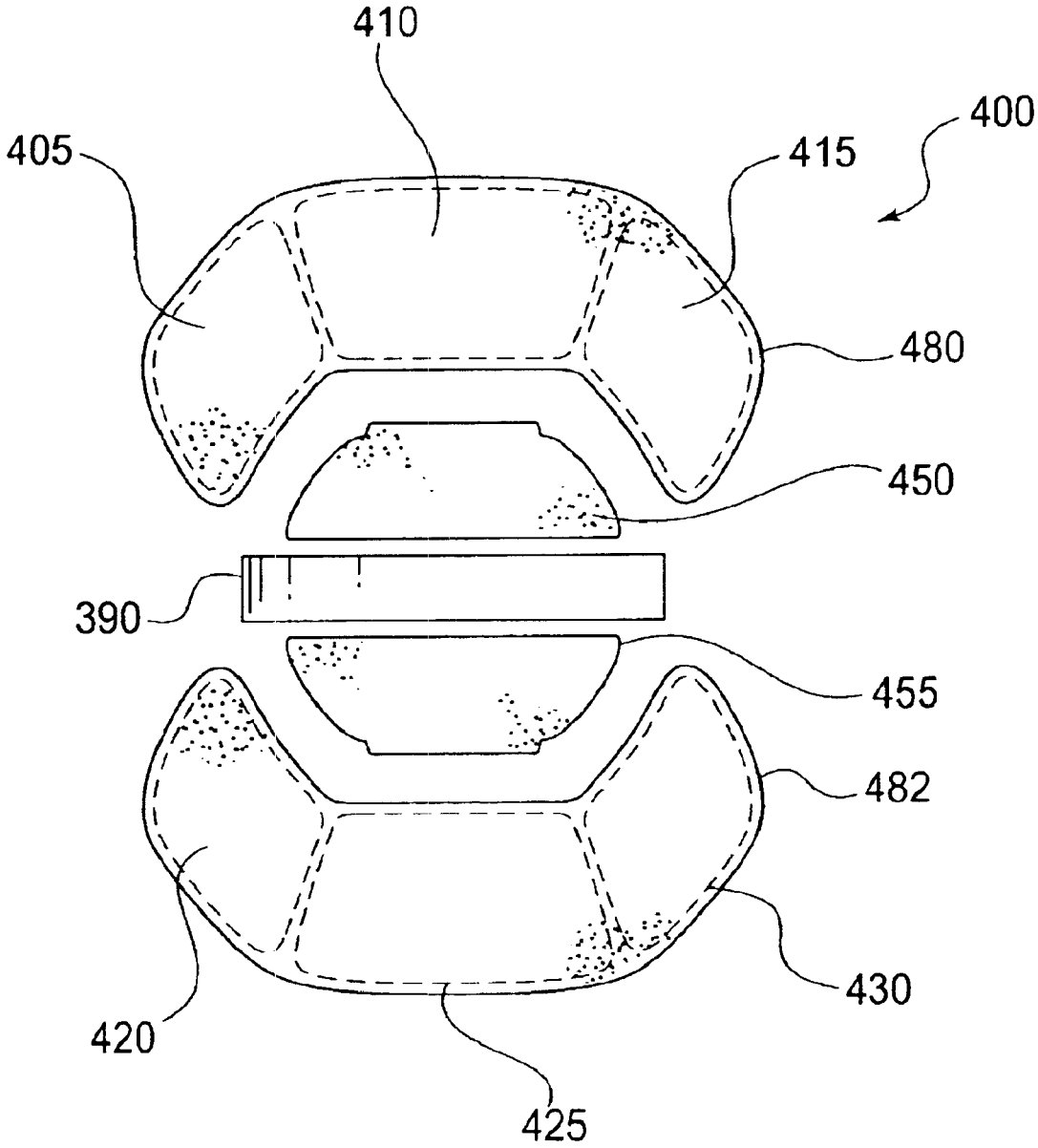
FIG. 4 is a diagram illustrating an exemplary adjustable pad set 400 for a protective helmet, according to another illustrative embodiment of the present invention.

FIG. 4 is a diagram illustrating an exemplary adjustable pad set 400 for a protective helmet, according to another illustrative embodiment of the present invention. The adjustable pad set 400 includes a plurality of pads 405, 410, 415, 420, 425, 430, 450, and 455. The adjustable pad set further includes at least two pad pockets 480, 482, each for holding two or more pads (e.g., 405–430 and 450–455) therein. The pad pockets 480, 482 allow for the combining of two or more pads into a larger pad. Moreover, one or more pads (e.g., 405–430 and 450–455) and one or more internal pads 110 may be combined and included in a given pad pocket. That is, internal pads 110 without an outer pocket 120 may be placed in the pad pockets 480, 482, so that the pad pockets 480, 482 serve as outer pockets. The pad pockets 480, 482 may be formed from, but not limited to, the following fabrics and/or other materials: looped knit nylon.

It is preferable that the material(s) that forms the pad pockets 480, 482 have at least one and preferably more than one of the following properties: waterproof or, at the least, water resistant; mildew and fungus resistant; durable; washable; and reversible. Each of the individual pads 405, 410, 415, 420, 425, 430, 450, and 455 may be formed from one or more internal pads 110 and a pad retaining/locating device 120.

The pad pockets 480, 482 may be arranged to provide a similar "underlying arrangement" as the pattern shown in FIG. 3, with the exception that the many edges of the six pads 405, 410, 415, 420, 425, and 430 as felt by the wearer have been replaced with the edges of only two larger pad pockets 480, 482.

It is to be appreciated that crown pads 450, 455 may also be disposed in a pad pocket as well. Such a pad pocket is preferably but not necessarily circular or oval in shape. Moreover, such a pad pocket may be sized and adapted to enclose the crown pads 450, 455 while still allowing the headband 390 of the audio headset to pass in between the crown pads 450, 455. Such a pad pocket may have apertures for allowing the headband 390 to pass there through or may have allow the headband 390 to rest in between the pad pocket and the helmet shell (or in between the pad pocket and the head of the wearer) while further allowing the crown pads 450, 455 to lie adjacent to the headband 390.

Figure 5:
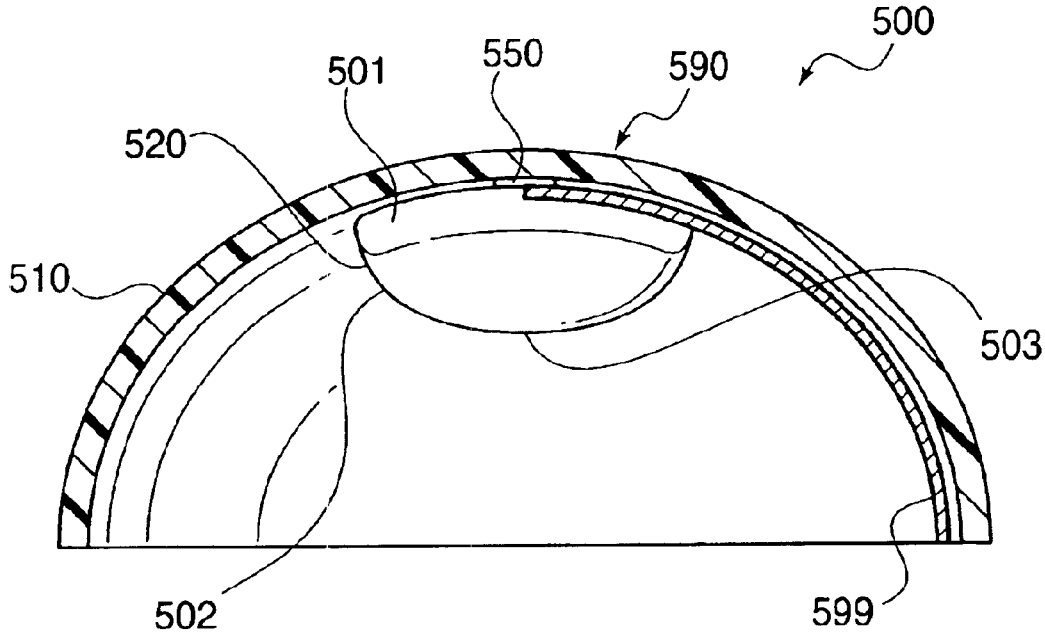
FIG. 5 is a cross-sectional view of a protective helmet 500 taken along line V-V of FIG. 3, according to an illustrative embodiment of the present invention.

FIG. 5 is a cross-sectional view of a protective helmet 500 taken along line V—V of FIG. 3, according to an illustrative embodiment of the present invention. The protective helmet 500 in the illustrative embodiment of FIG. 5 is capable of being used with an audio headset (not shown in its entirety) having a headband 599. Advantageously, the protective helmet 500 provides impact protection to a wearer while allowing the wearer to simultaneously wear an audio headset, all while further allowing the wearer to custom fit the pads to his or her preference.

While the illustrative embodiment is shown and described with respect to pads that correspond to the crown portion of the helmet, other pads such as those described here above may also be utilized to protect other areas of the wearer's head.

Moreover, while only one pad (first re-locatable pad 520) and only one fastener (first fastener 550) are shown in FIG. 5 for purposes of clarity, the following description is directed to two pads and two fasteners since the second pad and second fastener will function similar to the first pad and first fastener and will be located behind the first pad and first fastener when viewed in the opposite direction to that shown with respect to line V—V of FIG. 3. However, it is to be appreciated that only one pad could be used, while still maintaining the spirit and scope of the present invention.

The protective helmet 500 includes a padded shell 510. The padded shell 510 includes a first re-locatable pad 520 and a second re-locatable pad (not shown). The first re-locatable pad 520 and the second re-locatable pad can be considered to provide a headband receiving zone 590 when arranged as described below.

During headband use, the first re-locatable pad 520 and the second re-locatable pad both have an arcuate-shaped edge 501 and a spherical section 502 extending away from the arcuate-shaped edge 501.

The protective helmet 500 further includes a first fastener 550 and second fastener (not shown) to respectively secure the first re-locatable pad 520 and the second re-locatable pad outside the headband receiving zone 590 during headband use such that the arcuate-shaped edges 501 of the first re-locatable pad 520 and the second re-locatable pad are respectively co-linear with a crown section of the headband and, further, such that spherical sections 502 of the first re-locatable pad 520 and the second re-locatable pad, in addition to respectively extending away from the arcuate-shaped edges 501, also respectively extend away from the headband 599.

It is to be appreciated that in the case the audio headset is not used (and, thus, the headband is not present) the first re-locatable pad 520 and the second re-locatable pad may be placed within the headband receiving zone such that the first fastener 550 and the second fastener are positionable so as to secure the first re-locatable pad 520 and the second re-locatable pad such that the arcuate-shaped edge 501 of the first re-locatable pad 520 is adjacent the arcuate-shaped edge 501 of the second re-locatable pad.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. In combination a pad set and a protective helmet including a crown portion, the pad set comprising:

a plurality of internal pads of various thicknesses, wherein each of said internal pads is waterproof;

a plurality of pad retaining/locating devices, each having a pocket for receiving one or more of the plurality of waterproof internal pads so as to form an individual pad of the pad set; and at least one fastener for each of the plurality of pad retaining/locating devices for respectively securing the each of the plurality of pad retaining/locating devices to a selected location within the protective helmet;

wherein at least two of the individual pads are positioned in the crown portion so as to surround, and not overlap, at least a portion of an audio headset headband extending from ear to ear, while providing cushioning from impact for a crown of a head of a wearer.

2. The pad set according to claim 1, wherein the at least one fastener is a hook and pile fastener.

3. The pad set according to claim 1, wherein at least one of the plurality of pad retaining/locating devices comprises at least one other fastener for keeping the pocket closed to retain any of the plurality of internal pads therein.

4. The pad set according to claim 3, wherein the at least one other fastener is a hook and pile fastener.

5. The pad set according to claim 1, wherein each of the plurality of internal pads is formed from at least one of viscoelastic foam and polyurethane foam.

6. The pad set according to claim 1, wherein a plurality of individual pads of the pad set are capable of being formed from the plurality of pad retaining/locating devices and the plurality of waterproof internal pads.

7. The pad set according to claim 6, wherein each of the at least two of the plurality of individual pads is semi-circular in shape.

8. The pad set according to claim 1, wherein the plurality of internal pads comprises various shaped waterproof internal pads.

9. The pad set according to claim 8, wherein the various shaped waterproof internal pads correspond to different areas of a head of a wearer.

10. The pad set according to claim 8, wherein the various shaped waterproof internal pads correspond to at least one of a crown area, a front dome area, a rear dome area, a side dome area, and a side area of a user's head.

11. The pad set according to claim 1, wherein at least some of the plurality of pad retaining/locating devices comprises various shaped pad retaining/locating devices.

12. The pad set according to claim 11, wherein the various shaped pad retaining/locating devices correspond to different areas of a head of a wearer.

13. The pad set according to claim 1, further comprising at least one outermost pad pocket adapted to receive at least two of the plurality of pad retaining/locating devices to form a larger individual pad of the adjustable pad set.

14. The pad set according to claim 6, further comprising an outermost pad pocket adapted to receive the at least two of the plurality of individual pads that are adapted to be positioned in the crown portion.

15. The adjustable pad set according to claim 14, wherein the outermost pad pocket is further adapted to allow the headband of the audio headset to at least one of pass there through or lie adjacent thereto.

16. A protective helmet capable of being worn with an audio headset having a headband extending from earcup to earcup, the protective helmet comprising:

a padded shell having a re-locatable pad to provide a headset headband receiving zone and including nape and brow portions, wherein the re-locatable pad is water proof; and a fastener to secure the re-locatable pad outside the headset headband receiving zone to avoid overlapping the headset headband so that during headset headband use the re-locatable pad has an arcuate-shaped edge adapted to be co-linear with a crown section of the headset headband and a spherical section extending away from the arcuate-shaped edge in a direction towards one of the nape and brow portions and terminating in a crescent shaped edge.

17. The protective helmet of claim 16, wherein said padded shell further has another re-locatable pad, and said protective helmet further comprises another fastener to secure the other re-locatable pad outside the headset headband receiving zone so that during the headset headband use the other re-locatable pad has the arcuate-shaped edge adapted to be co-linear with the crown section of the headset headband and the spherical section extending away from the arcuate-shaped edge in a direction towards one of the nape and brow portions.

18. The protective helmet of claim 16, wherein said padded shell further has another re-locatable pad, and said protective helmet further comprises another fastener, and wherein the fastener of the re-locatable pad and the other fastener of the other pad are positionable so as to secure the pad and the other pad such that the arcuate-shaped edge of the pad is adjacent the arcuate-shaped edge of the other pad in an absence of the headset headband at the headset headband receiving zone.

19. The protective helmet of claim 16, wherein the re-locatable pad comprises:

a plurality of waterproof internal pads of various thickness; and a pad retaining/locating device having a pocket for receiving at least one of the plurality of waterproof internal pads.

20. In combination a pad set and a protective helmet including a crown portion, the pad set comprising:

a plurality of waterproof internal pads of various thicknesses;

a plurality of pad retaining/locating devices, each having a pocket for receiving one or more of the plurality of waterproof internal pads so as to form an individual pad of the pad set; and at least one fastener for each of the plurality of pad retaining/locating devices for respectively securing the each of the plurality of pad retaining/locating devices to a selected location within the protective helmet;

wherein at least two of the individual pads are positioned in the crown portion so as to surround, and not overlap, at least a portion of an audio headset headband extending from ear to ear, while providing cushioning from impact for a crown of a head of a wearer;

wherein at least one of said plurality of waterproof internal pads and said plurality of pad retaining/locating devices is mildew and fungus resistant.

* * * * *